US009216805B1

(12) United States Patent
Amerling et al.

(10) Patent No.: US 9,216,805 B1
(45) Date of Patent: Dec. 22, 2015

(54) COWL MOUNTING SYSTEM FOR OUTBOARD MARINE DRIVE

(71) Applicant: Brunswick Corporation, Lake Forest, IL (US)

(72) Inventors: Steven J. Amerling, Fond du Lac, WI (US); Brad J. Van Ruiswyk, Waupun, WI (US)

(73) Assignee: Brunswick Corporation, Lake Forest, IL (US)

( * ) Notice: Subject to any disclaimer, the term of this patent is extended or adjusted under 35 U.S.C. 154(b) by 194 days.

(21) Appl. No.: 13/922,916

(22) Filed: Jun. 20, 2013

Related U.S. Application Data

(60) Provisional application No. 61/666,060, filed on Jun. 29, 2012.

(51) Int. Cl.
*B63H 20/32* (2006.01)

(52) U.S. Cl.
CPC ..... *B63H 20/32* (2013.01)

(58) Field of Classification Search
CPC ..... B63H 2020/323; B63H 2020/32; B63H 2020/36
USPC ..... 440/76, 77; 123/195 P
See application file for complete search history.

(56) References Cited

U.S. PATENT DOCUMENTS

| | | | | |
|---|---|---|---|---|
| 3,955,526 | A | 5/1976 | Kusche | |
| 4,216,984 | A | 8/1980 | Hofmann et al. | |
| 4,348,194 | A | 9/1982 | Walsh | |
| 4,600,396 | A | 7/1986 | Crane et al. | |
| 4,800,854 | A | 1/1989 | Boda et al. | |
| 4,844,031 | A | 7/1989 | Boda et al. | |
| 4,860,703 | A | 8/1989 | Boda et al. | |
| 4,867,120 | A | 9/1989 | Boda et al. | |
| 4,871,333 | A | 10/1989 | Curtis et al. | |
| 4,875,883 | A | 10/1989 | Slattery | |
| 4,878,468 | A | 11/1989 | Boda et al. | |
| 4,927,194 | A | 5/1990 | Wagner | |
| 4,930,790 | A | 6/1990 | Sheridan | |
| 4,932,909 | A | 6/1990 | Curtis et al. | |
| 5,025,763 | A | 6/1991 | Watanabe | |
| 5,120,248 | A | 6/1992 | Daleiden et al. | |
| 5,338,236 | A | 8/1994 | Dunham et al. | |
| 5,487,687 | A | 1/1996 | Idzikowski et al. | |
| 6,080,025 | A | 6/2000 | Isogawa et al. | |
| 6,179,350 | B1 | 1/2001 | Ely et al. | |
| 6,283,806 | B1 | 9/2001 | Schmidt et al. | |
| 6,659,817 | B1 | 12/2003 | Anderson et al. | |
| 6,663,450 | B1 | 12/2003 | Walczak et al. | |
| 6,669,517 | B1 * | 12/2003 | Alby et al. | 440/77 |
| 6,682,379 | B1 | 1/2004 | Walczak et al. | |
| 6,840,827 | B2 | 1/2005 | Vignau | |
| 6,991,500 | B1 | 1/2006 | Gulko et al. | |
| 7,201,623 | B1 | 4/2007 | Krupp et al. | |
| 7,267,592 | B1 | 9/2007 | Ingebritson et al. | |
| 7,938,704 | B2 | 5/2011 | Nomura et al. | |
| 8,011,982 | B1 | 9/2011 | Baier et al. | |
| 2005/0191915 | A1 * | 9/2005 | Nakamura | 440/77 |

* cited by examiner

*Primary Examiner* — S. Joseph Morano
*Assistant Examiner* — Andrew Polay
(74) *Attorney, Agent, or Firm* — Andrus Intellectual Property Law, LLP

(57) ABSTRACT

A cowl mounting system includes one or more stabilizer fulcrums spaced between front and rear cowl mounts and preloading the cowl to provide cowl stability in the mounted condition. The stabilizer fulcrums also provide port and starboard alignment guides during assembly.

17 Claims, 9 Drawing Sheets

COWL MOUNTING SYSTEM FOR OUTBOARD MARINE DRIVE

CROSS REFERENCE TO RELATED APPLICATION

This application claims the benefit of and priority from Provisional U.S. Patent Application No. 61/666,060, filed Jun. 29, 2012, hereby incorporated herein by reference.

BACKGROUND AND SUMMARY

The present disclosure relates to cowl mounting systems for outboard marine drives.

Cowl mounting arrangements are known in the prior art for outboard marine drives propelling a marine vessel, the outboard marine drive having an upper powerhead covered by the upper cowl. The cowl mounting arrangement typically includes front and rear mounts or latches mounting the upper cowl to the outboard marine drive in covering relation to the upper powerhead. The outboard marine drive is subject to impact-strike against a submerged object, e.g. log-strike, during propulsion of the marine vessel. The impact-strike can cause at least one dislodgement force vector tending to dislodge the upper cowl from one or both of the front and rear mounts. In another aspect, the upper cowl is typically a large bulky member with perimeteral spans which may make alignment during assembly a challenge.

The present disclosure arose during continuing development efforts in the above technology.

DETAILED DESCRIPTION

Figure 1:
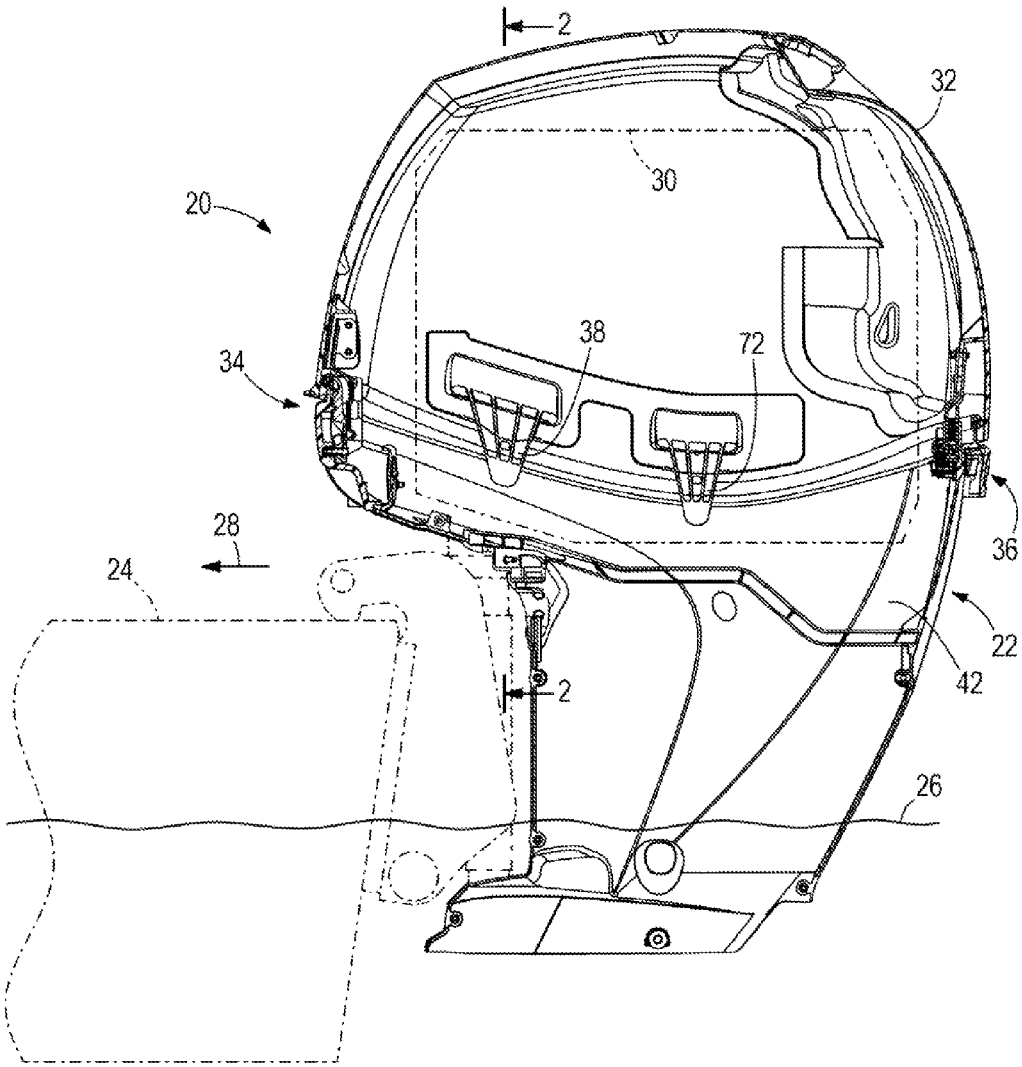
FIG. 1 is a side view, partially cut-away showing a cowl mounting arrangement for an outboard marine drive.
Figure 2:
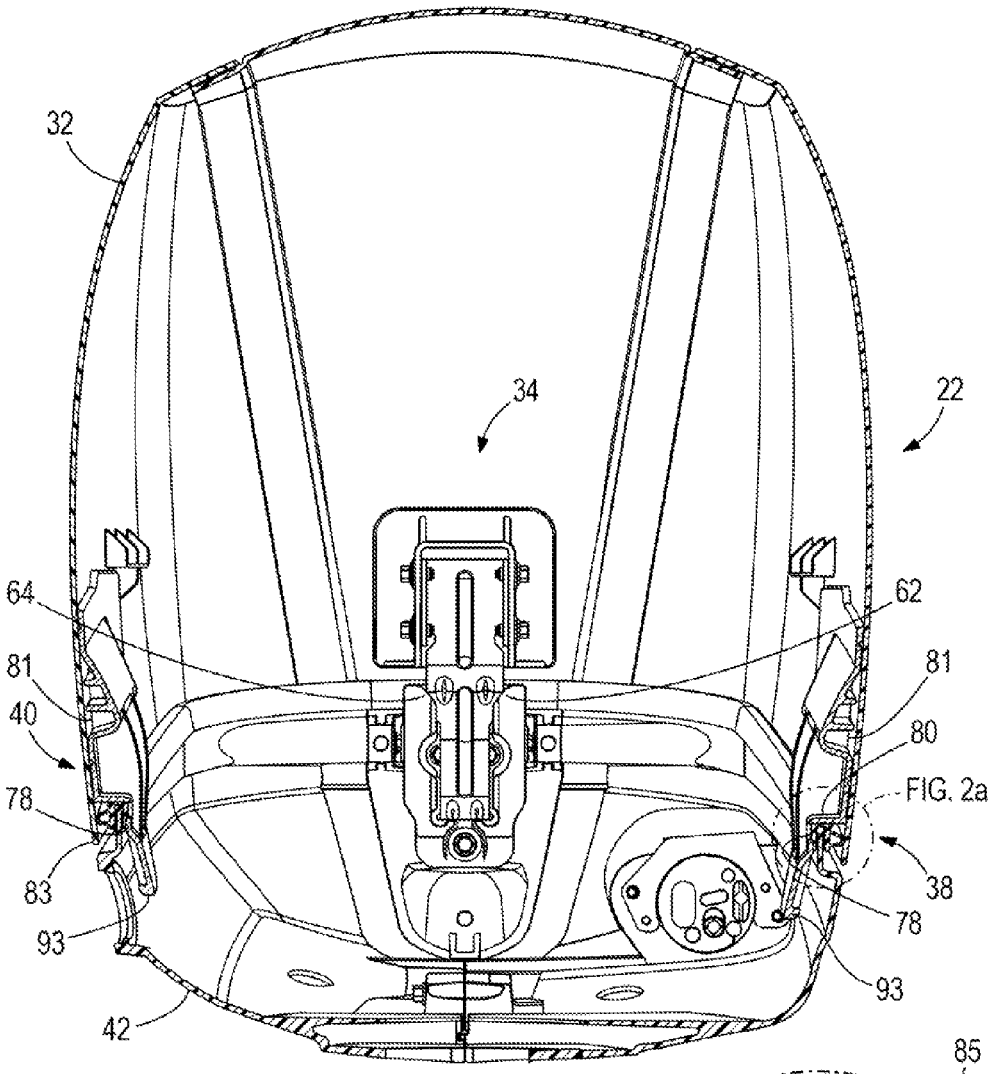
FIG. 2 is a sectional view taken along line 2-2 of FIG. 1.

FIG. 1 shows a cowl mounting arrangement 20 for an outboard marine drive 22 propelling a marine vessel 24 in a body of water 26, including in a forward direction 28. The outboard marine drive 22 has an upper powerhead, shown schematically at 30, covered by an upper cowl 32. The cowl mounting arrangement 20 includes front and rear mounts or latches 34 and 36 that mount the upper cowl 32 to the outboard marine drive 22 in covering relation to the upper powerhead 30. The upper cowl 32 has a mounted condition, FIG. 1, mounted to the outboard marine drive 22 by the front and rear mounts or latches 34, 36. At least one and in the disclosed embodiment two stabilizer fulcrums 38 and 40, FIGS. 1, 2, are spaced between the front and rear mounts or latches 34 and 36 and preload the upper cowl 32 to provide upper cowl 32 stability in the mounted condition, as will be described herein below. In FIG. 1, the starboard half of the upper cowl 32 is depicted, to show starboard stabilizer fulcrum 38. FIG. 2 is a sectional view taken along line 2-2 of FIG. 1 and shows both the starboard stabilizer fulcrum 38 and port stabilizer fulcrum 40.

The upper cowl 32 engages both of the front and rear mounts or latches 34, 36 in the mounted condition, FIG. 1. The upper cowl 32 has a partially mounted condition, FIG. 3, and a further partially mounted condition, FIG. 4, engaging one of the front and rear mounts or latches 34, 36, for example front mount 34, prior to engaging the other of the front and rear mounts or latches 34, 36, for example rear mount 36. The starboard and port stabilizer fulcrums 38 and 40 preload the cowl 32 as it is moved from the partially mounted condition, FIGS. 3, 4, to the mounted condition, FIG. 1, and maintain a load on the upper cowl 32 in the mounted condition. In use, the outboard marine drive 22 is subject to impact-strike against a submerged object, e.g. a log-strike, during propelling of the marine vessel 24, and the impact-strike can cause at least one dislodgement force vector tending to dislodge the upper cowl 32 from the front and/or the rear mounts or latches 34, 36. As described herein below, the unique configuration of at least one of the mounts or latches 34, 36, for example the mount or latch 34, in combination with the noted maintained load on the upper cowl 32 provided by the stabilizer fulcrums 38, 40, together operate to retain the upper cowl 32 in the mounted condition against the noted dislodgement force vector.

In one embodiment, the marine vessel 24 has port and starboard sides, and the noted port stabilizer fulcrum 40 and starboard stabilizer 38 fulcrum are spaced between the front and rear mounts or latches 34 and 36 at laterally distally opposite port and starboard sides of the upper cowl 32 and preload the upper cowl 32 and to provide upper cowl 32 stability in the mounted condition thereof. In this embodiment, the upper cowl 32 covers the upper powerhead 30 and is removable therefrom. A lower cowl 42 is attached to the outboard marine drive 22, as is known, and is disposed below the upper cowl 32. The upper and lower cowls 32, 42 both have front and rear ends, and port and starboard sides. The port stabilizer fulcrum 40 is on the port side of one of the upper and lower cowls 32, 42, for example the upper cowl 32, and engages the port side of the other of the upper and lower cowls 32, 42, for example the lower cowl 42. The starboard stabilizer fulcrum 38 is on the starboard side of one of the upper and lower cowls 32, 42, for example the upper cowl 32, and engages the starboard side of the other of the upper and lower cowls 32, 42, for example for the lower cowl 42. The upper cowl 32 is mounted to the outboard marine drive 22 at front and rear mounts or latches 34 and 36. One of the mounts or latches 34, 36, for example the front mount or latch 34, includes a hook 44, FIGS. 5-12, on one of the upper and lower cowls 32, 42, for example, upper cowl 32, and a retainer 46, FIGS. 5-8, 13-16, on the other of the upper and lower cowls 32, 42, for example the lower cowl 42. The dislodgement force vector caused by an impact-strike that would tend to separate the upper cowl 32 from the lower cowl 42 and release the hook 44 from the retainer 46 is counter-acted by the unique configuration of and engagement between the hook 44 and retainer 46 in combination with the noted preloading provided by the port and starboard stabilizer fulcrums 38, 40.

To attach the upper cowl 32 to the lower cowl 42, the upper cowl 32 is rocked on the starboard and port fulcrums 38 and 40 to engage and preload hook 44 with respect to retainer 46. The upper cowl 32 is further rocked on the port and starboard stabilizer fulcrums 38, 40 until latched by the other of the mounts or latches 34, 36, for example rear latch 36. Engagement of the upper and lower cowls 32, 42 at latch 36 maintains the preload and provides a maintained load on the upper cowl 32. Hook 44 and retainer 46 in the disclosed embodiment are at the front end of the upper and lower cowls 32, 42, and the other mount or latch 36 is at the rear end of the upper and lower cowls 32, 42. Rear latch 36 can be a standard latch known in the prior art, for example a Mercury Marine Rear Latch Assembly, Part No. 8M0041031. This orientation could be the opposite, wherein the hook 44 and retainer 46 are on the rear end and the standard latch is at the front end.

In the depicted embodiment, hook 44, FIGS. 5-12, has an upper attachment bracket 45 that is fixedly attached to a mounting bracket 47 on the upper cowl 32. The attachment bracket 45 has a base surface 49 that faces a mounting surface 43 on the mounting bracket 47 and also has opposed ears 69 that extend transversely from the base surface 49 and are fixed to bracket surfaces 55 that correspondingly extend transversely from the mounting surface 43 of the mounting bracket 47. The hook 44 also has a transition member 57 that extends transversely from the lower end 59 of the base surface 49 and transitions to a downwardly extending shank 51. A horizontally extending finger 52 transversely extends from the lower end 53 of the downwardly extending shank 51. In use, the finger 52 engages the retainer 46 and prevents vertical displacement of the hook 44 and upper cowl 32 in the noted mounted condition, FIG. 5, as will be described further herein below.

Figure 8:
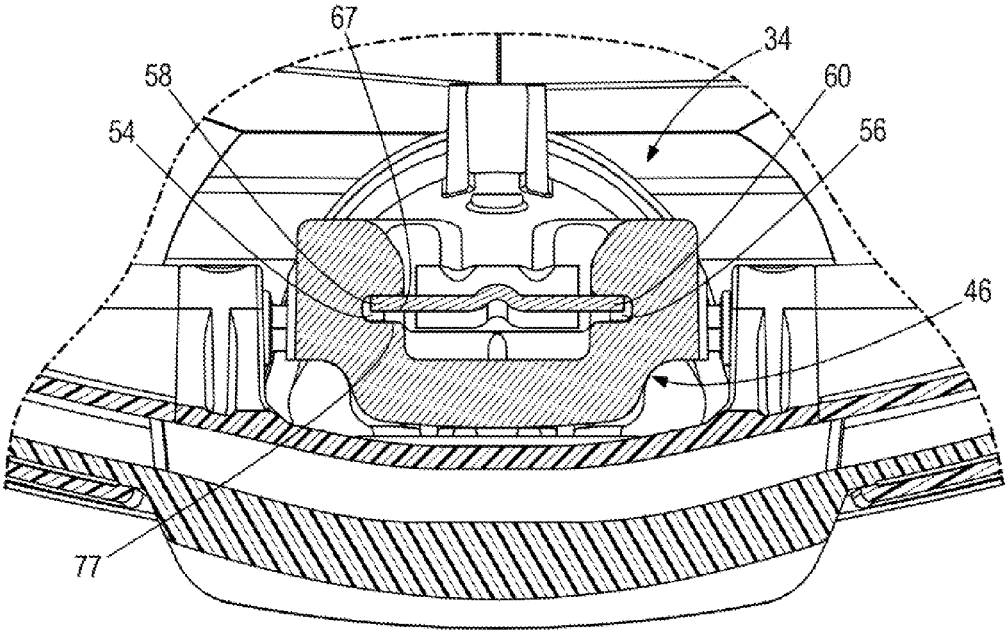
FIG. 8 is a sectional view taken along line 8-8 of FIG. 5.
Figure 12:
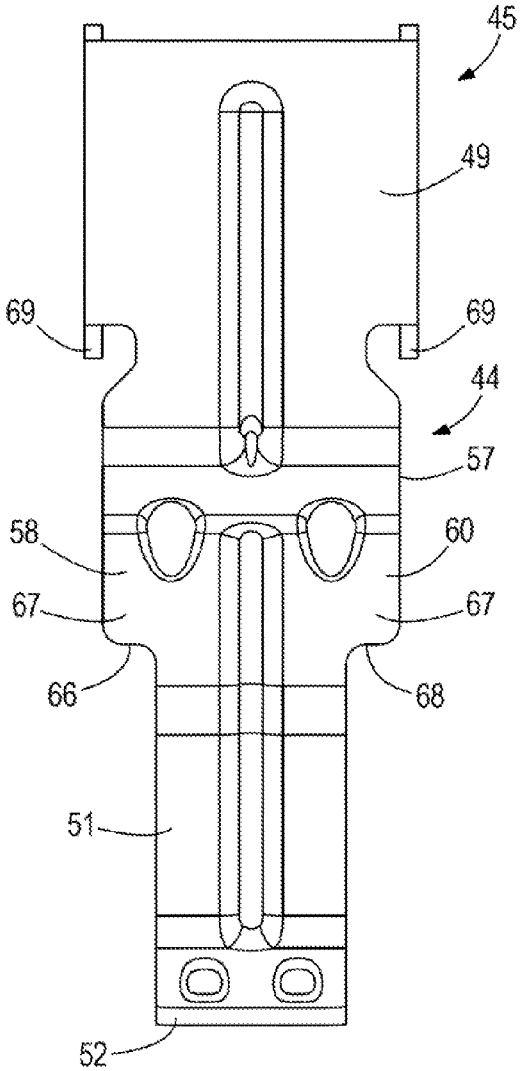
FIG. 12 is another side view of the component of FIG. 10.
Figure 13:
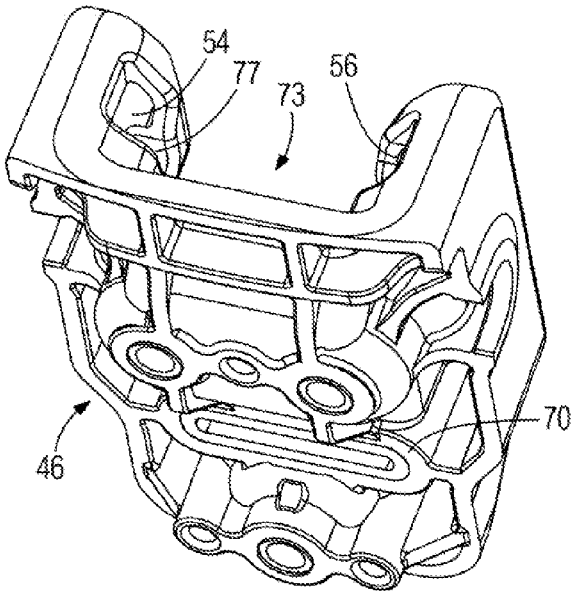
FIG. 13 is a perspective view of another component of FIG. 5.
Figure 14:
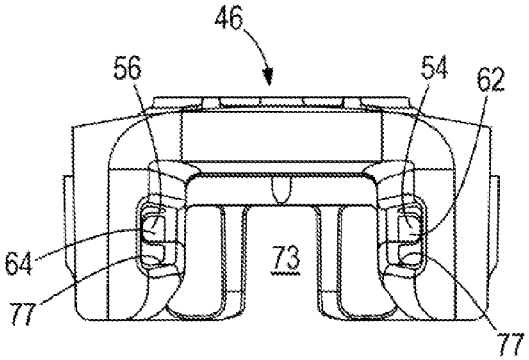
FIG. 14 is a top view of the component of FIG. 13.

Retainer 46, FIGS. 5-8, 13-16, defines an interior recess 73, FIGS. 13-16, for receiving the shank 51 of hook 44 and also defines two opposed vertical slots 54 and 56, FIGS. 8, 13, 14, therein. Hook 44 along shank 51 has shoulders 58 and 60, FIGS. 8-10, 12, extending vertically into respective vertical slots 54 and 56 when the shank 51 of the hook 44 is inserted into the interior recess 73. Fitting of shoulders 58 and 60 in vertical slots 54 and 56 prevents horizontal displacement of the hook 44 from the retainer 46 in the mounted condition, FIGS. 1, 5, 8.

Figure 9:
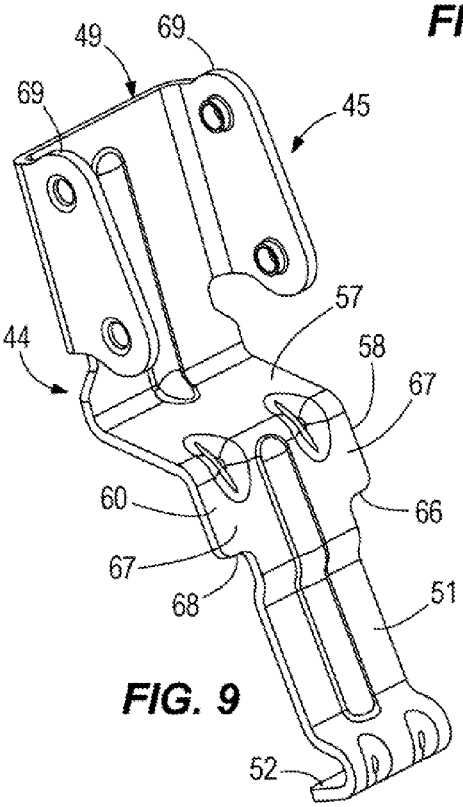
FIG. 9 is a perspective view of a component of FIG. 5.
Figure 10:
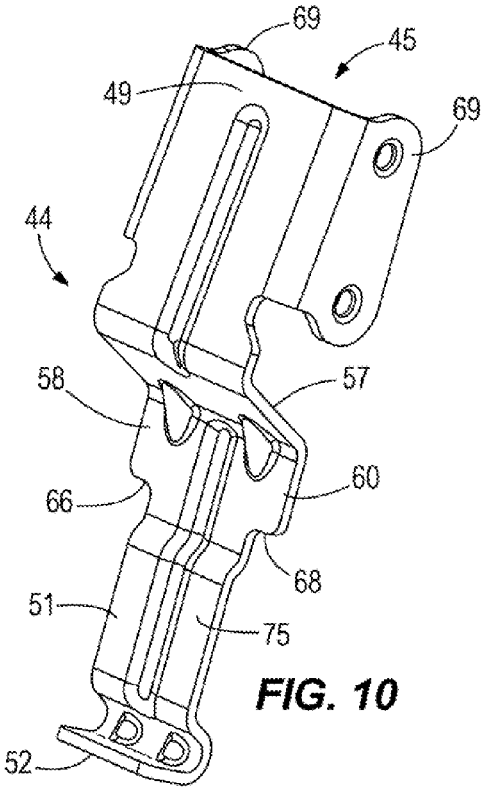
FIG. 10 is a perspective view of the component of FIG. 9 from a different angle.
Figure 11:
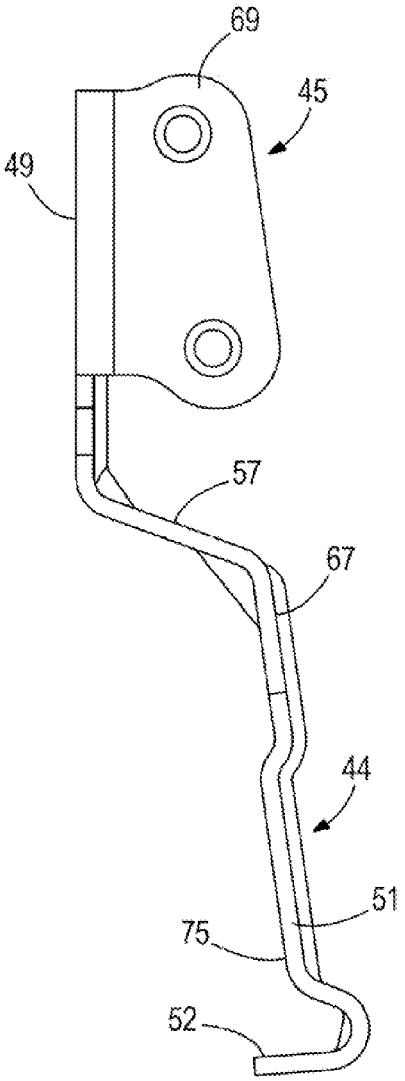
FIG. 11 is a side view of the component of FIG. 10.
Figure 15:
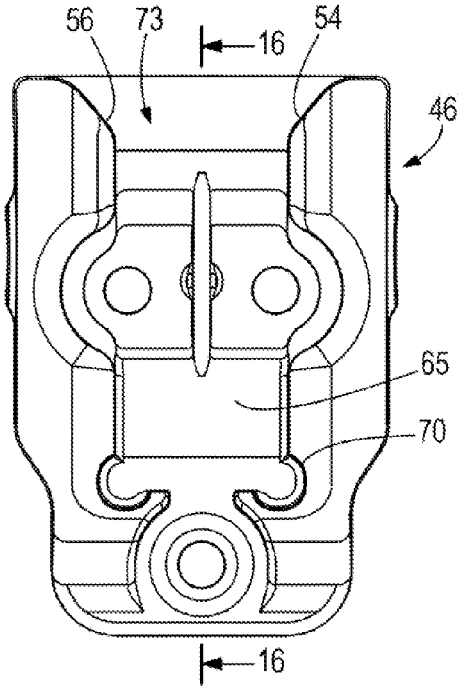
FIG. 15 is a side view of the component of FIG. 13.
Figure 16:
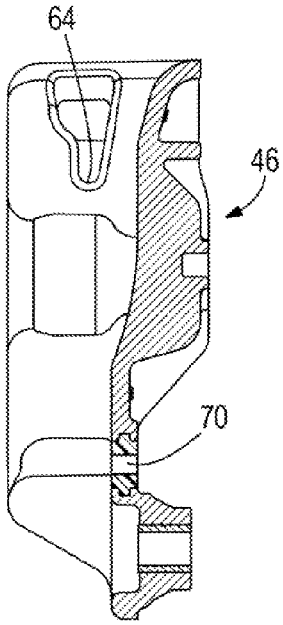
FIG. 16 is a sectional view take along line 16-16 of FIG. 1S.

Vertical slots 54 and 56 of the retainer 46 have respective stop surfaces 62 and 64, FIGS. 2, 15, and shoulders 58 and 60 of hook 44 have respective lower faces 66 and 68, FIGS. 9, 10, 12, facing respective stop surfaces 62 and 64. The hook 44 is inserted generally vertically into the interior recess 73 and with shoulders 58, 60 extending into vertical slots 54 and 56 until either the outer forward perimeteral edge 61 of upper cowl 32 engages the outer forward perimeteral edge 63 of the lower cowl 42, see FIGS. 5-7, or alternatively until lower faces 66 and 68 of the shoulders engage with stop surfaces 62 and 64 of vertical slots 54 and 56. The upper cowl 32 carrying hook 44 is then pivoted (clockwise in FIGS. 6 and 7 to the position in FIG. 5) to pivot the upper cowl 32 to the mounted position, FIGS. 5, 1, engaging rear latch 36.

Figure 3:
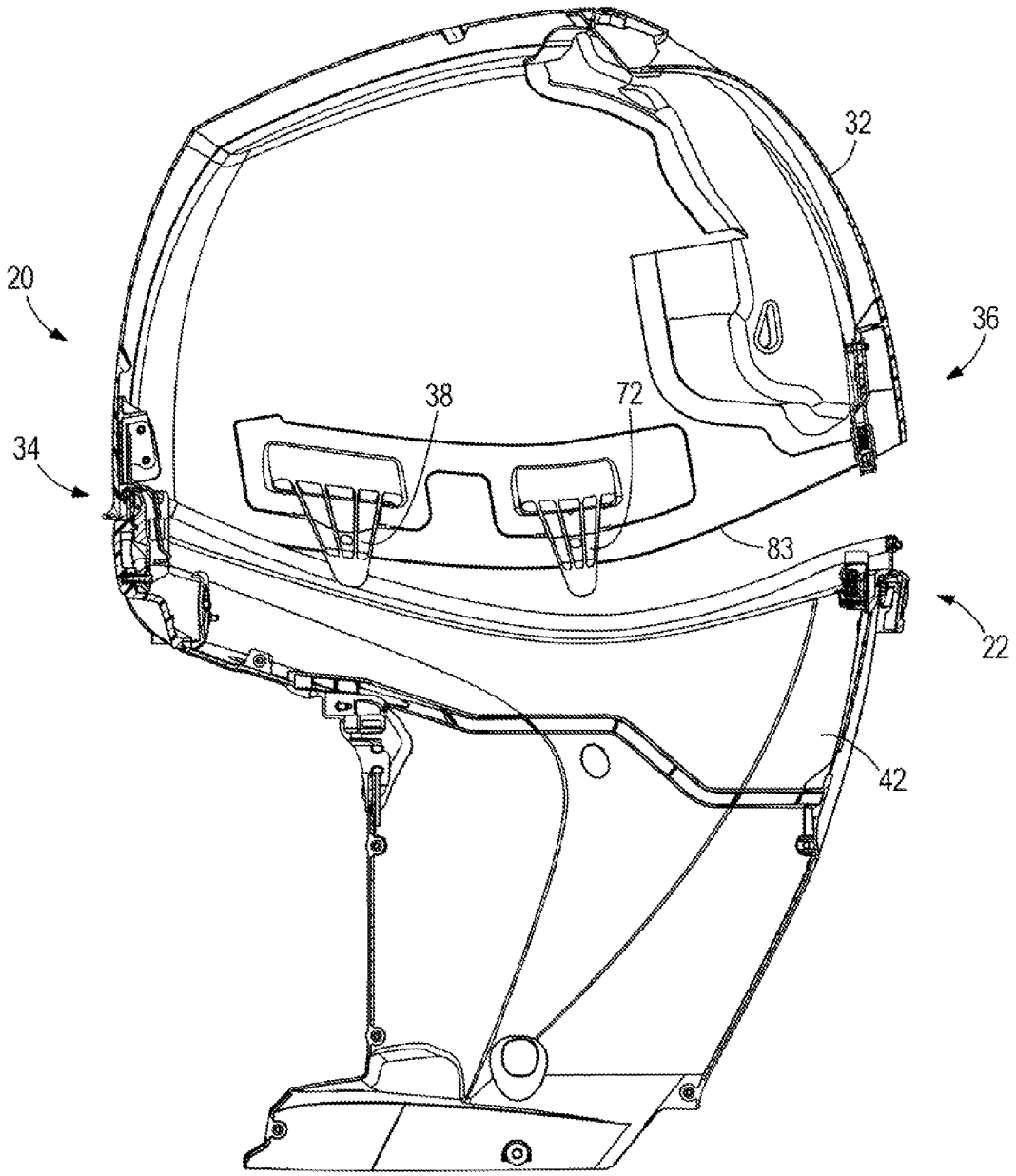
FIG. 3 is like FIG. 1 and shows a sequential step during assembly and mounting.
Figure 4:
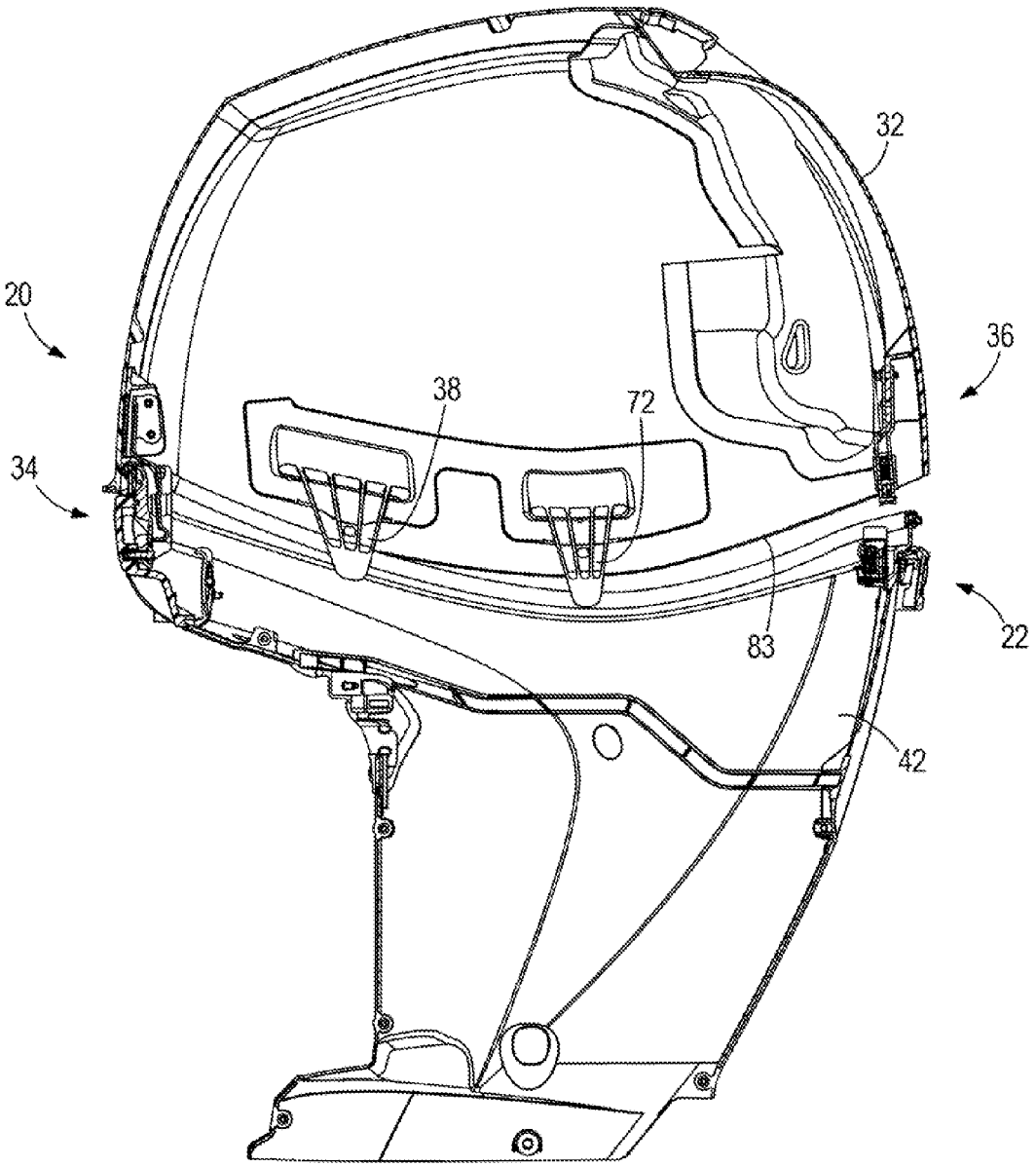
FIG. 4 is like FIG. 3 and shows a further sequential step.
Figure 7:
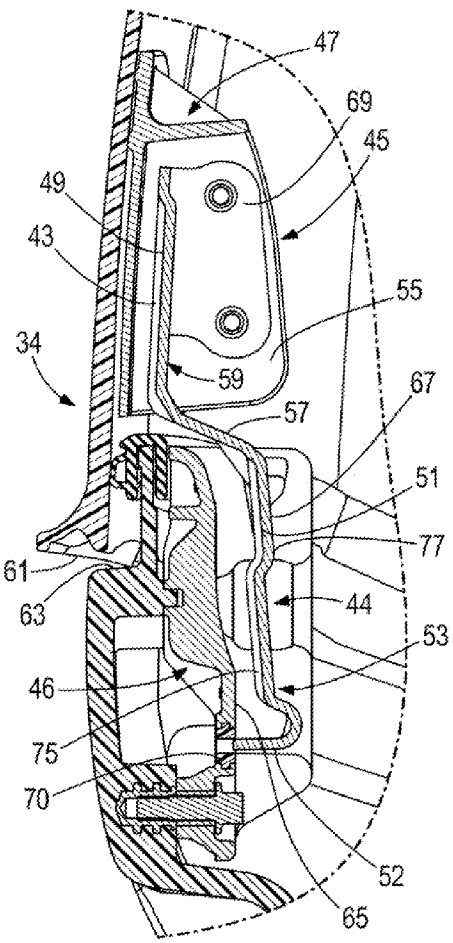
FIG. 7 is like FIG. 6 and shows a further sequential step corresponding to FIG. 4.
Figure 6:
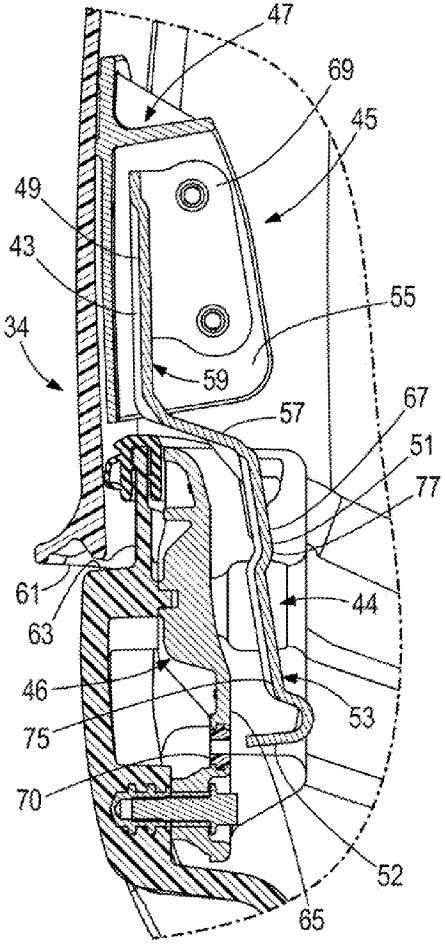
FIG. 6 is like FIG. 5 and shows a sequential step during assembly and mounting corresponding to FIG. 3.

During assembly, the upper cowl 32 is placed above the lower cowl 42 and in a slightly forward-tilted position, FIG. 3. Hook 44 is moved downwardly, with shoulders 58 and 60 sliding downwardly in respective vertical slots 54 and 56, whereafter the upper cowl 32 and hook 44 are pivoted clockwise in FIGS. 6 and 7, such that finger 52 pivots generally horizontal forwardly (leftwardly in FIGS. 5 and 7), into horizontal slot 70, FIGS. 13, 15, 16, in retainer 46, to provide the noted engagement of finger 52 with the retainer 46. Continued pivoting of the upper cowl 32 and hook 44 in the noted clockwise direction engages the starboard and port stabilizer fulcrums 38 and 40 with the lower cowl 42 and applies torque on and preloads the latch 34 as the rear latch 36 is engaged. More specifically, pivoting motion in the clockwise direction engages the stabilizer fulcrums 38, 40 with the lower cowl 42 and thus causes the lower interior surface 75 of the shank 51 to abut against the interior surface 65 of interior recess 73. Simultaneously, the upper exterior surface 67 of the shank 51 at shoulders 58, 60 engages with the exterior surface 77 of the vertical slots 54 and 56, see FIG. 8, thus applying torque on the hook 44 and preloading the hook 44 and upper cowl 32.

Figure 2A:
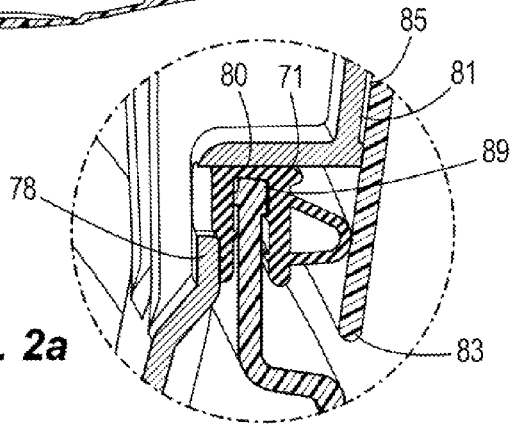
FIG. 2*a* is an enlarged view of a portion of FIG. 2.

Referring to the embodiment in FIGS. 2 and 2*a*, stabilizer fulcrums 38, 40 are attached to interior surface 81 of upper cowl 32 and extend downwardly from the lower perimeteral edge 83 of the upper cowl 32. Each stabilizer fulcrum 38, 40 has a vertically extending mounting surface 85 attached to the interior surface 81 of the upper cowl 32, a transversely extending transition surface or trunnion surface 80, providing the noted fulcrum functionality, and a downwardly extending alignment arm 78 having a finger 93. The trunnion surface 80 engages with the upper perimeteral edge 89 of the lower cowl 42, which can have a gasket 71 thereon for preventing water flow into the interior of the cowl mounting arrangement 20.

Thus, the unique configuration of and engagement between the hook 44 and retainer 46 in combination with the noted preloading provided by port and starboard stabilizer fulcrums 38, 40 better secures the upper cowl 32 with the lower cowl 42 so that impact-strike that would tend to dislodge the upper cowl 32 from the lower cowl 42 is counteracted. Pivoting of the upper cowl 32 with respect to the lower cowl 42 and across the stabilizer fulcrums 38, 40 engages the hook 44 with the retainer 46 and then applies torque on the hook 44 as the stabilizer fulcrums 38, 40 engage with the lower cowl 42. The noted torque increases as the upper cowl 32 is further pivoted into the mounted condition wherein latch 36 is engaged, as shown in FIG. 1, thus preloading the upper cowl 32 and providing a secure connection.

Figure 17:
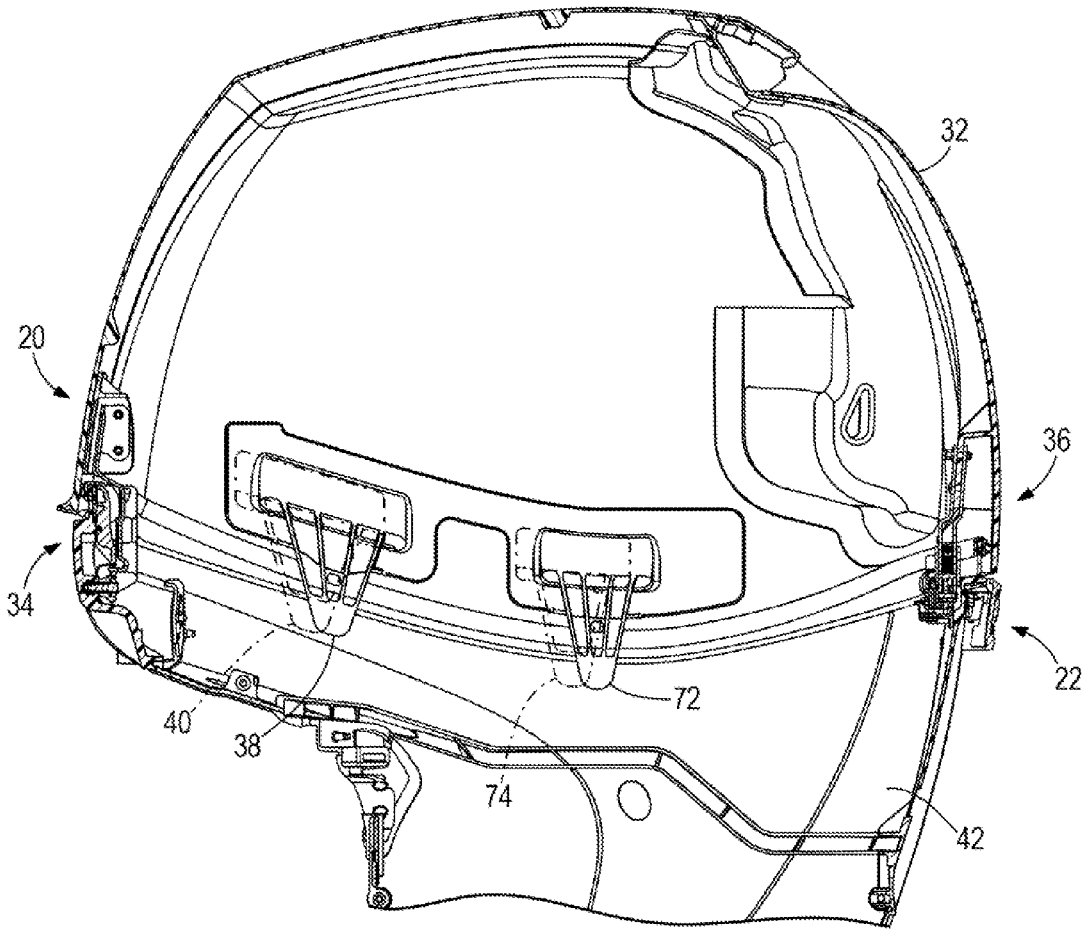
FIG. 17 is a side view, partially cut-away, of the cowl mounting arrangement of FIG. 1.

Starboard and port stabilizer fulcrums 38 and 40 also function as and provide starboard and port alignment guides, respectively, guiding the starboard side of upper cowl 32 into alignment with the starboard side of the lower cowl 42, and guiding the port side of upper cowl 32 into alignment with the port side of the lower cowl 42. In one embodiment, four alignment guides are provided, including two starboard alignment guides 38 and 72, FIGS. 1, 2, 17, and two port alignment guides 40 and 74. The two starboard alignment guides 38, 72 include forward starboard alignment guide 38 and aft starboard alignment guide 72 spaced rearwardly of forward starboard alignment guide 38. The two port alignment guides 40, 74 include forward port alignment guide 40 and aft port alignment guide 74 spaced rearwardly of forward port alignment guide 40. The aft alignment guides 72 and 74 may also act as stabilizer fulcrums in a further embodiment.

The port and starboard alignment guides 38, 40, 72, 74 are on the upper cowl 32 and extend downwardly beyond lower perimeteral edge 83, FIG. 3, of upper cowl 32. This allows a service technician to place or rest upper cowl 32 on the floor or other support surface without engaging or touching part or all of perimeteral edge 83 against the floor, which in turn minimizes the chances of damage thereto, which may be desirable when the lower perimeteral edge 83 includes a gasket. The port and starboard alignment guides 38, 40, 72, 74 also provide and comprise the noted port and starboard stabilizer fulcrums, spaced between front and rear mounts or latches 34 and 36 at laterally distally opposite port and starboard sides of the upper cowl 32 and preloading the upper cowl 32 to provide stability in the noted mounted condition of the upper cowl 32. Each of the port and starboard alignment guides 38, 40, 72, 74 has a vertical guide arm or surface, for example at 78, FIGS. 2, 2*a*, providing alignment guiding, and the trunnion surface 80 providing the respective fulcrum. The trunnion surface 80 abuts the upper perimeteral edge 89 of the lower cowl 42 when the upper cowl 32 is in the mounted condition. The gasket 71 can be provided on the upper perimeteral edge 89.

The disclosed systems provide methods for mounting a cowl on an outboard marine drive propelling a vessel, including in a forward direction, the outboard marine drive having an upper powerhead covered by the cowl and having front and rear mounts for mounting the cowl to the outboard marine drive in covering relation to the upper powerhead. The methods can include engaging the upper cowl 32 with the outboard marine drive 22 at one of the front and rear mounts or latches 34, 36, for example front mount 34, providing stabilizer fulcrums 38 and 40 between the front and rear mounts 34, 36, and pivoting the upper cowl 32 on the stabilizer fulcrums 38, 40 about a pivot-engagement to preload the upper cowl 32, FIGS. 3, 4, and continuing to pivot the upper cowl 32, FIG. 4, to a mounted position, FIGS. 1, 5, engaging the other of the front and rear mounts or latches 34, 36, for example rear mount or latch 36. The method includes maintaining, by use of the stabilizer fulcrums 38, 40, a load on the upper cowl 32 in the mounted position.

As discussed herein above, the outboard marine drive 22 can be subject to impact-strike against a submerged object during the propelling of the marine vessel 24, and the impact-strike may cause at least one dislodgement force vector which may tend to dislodge or de-couple the upper cowl 32 from the lower cowl 42. The methods maintain, by use of the stabilizer fulcrums 38, 40, the maintained load on the upper cowl 32 in the mounted condition, including in engagement with the mount 34, 36 against the dislodgement force vector. Upper cowl 32 is rocked on stabilizer fulcrums 38 and 40. The noted dislodgement force vector caused by an impact-strike may release the hook 44 from the retainer 46 but-for the unique configuration of hook 44 and retainer 46 in combination with the preloading provided by the rocking of the upper cowl 32 on the port and starboard stabilizer fulcrums 38, 40.

The methods can include providing the noted port and starboard alignment guides 38, 40 at the noted port and starboard fulcrums 38, 40, and comprising, during rocking of the upper cowl 32, guiding the port side of the upper cowl 32 at the port stabilizer fulcrum 38 and the port alignment guide 38 into alignment with the port side of the lower cowl 42, and during the rocking of the upper cowl 32, guiding the starboard side of the upper cowl 32 at the starboard stabilizer fulcrum 40 and the starboard alignment guide 40 into alignment with the starboard side of the lower cowl 42.

Figure 5:
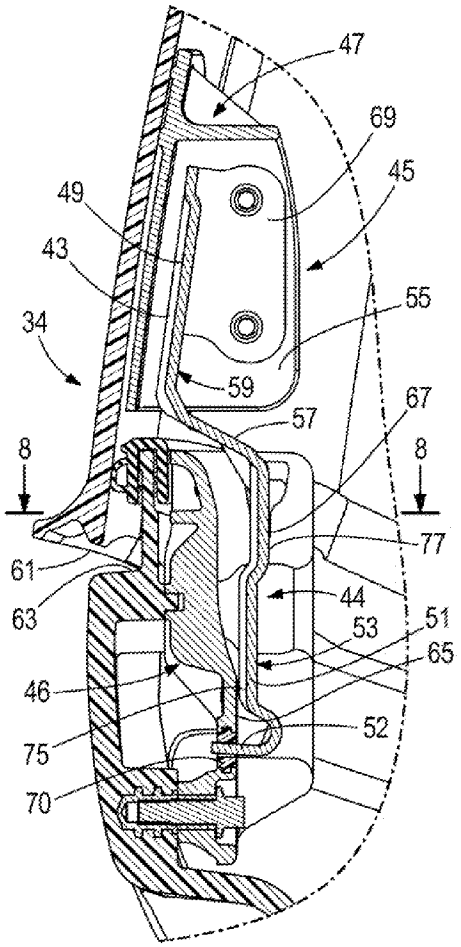
FIG. 5 is an enlarged view of a portion of FIG. 1.

The methods can include providing one of the mounts or latches 34 and 36 as a hook 44 on one of the upper and lower cowls 32, 42, and a retainer 46 on the other of the upper and lower cowls 32, 42, providing the hook with a finger 52 engaging the retainer 46 and preventing vertical displacement therefrom, FIG. 5, providing the retainer 46 with vertical slots 54, 56 therein, providing the hook 44 with shoulders 58, 60, sliding the shoulders 58, 60 vertically into vertical slots 54, 56, and then pivoting hook 44 on retainer 46 such that finger 52 engages the retainer, e.g. at slot 70, to prevent vertical displacement therefrom. The method includes providing the vertical slots 54, 56 of retainer 46 with stop surfaces 62, 64, providing the shoulders 58, 60 with lower faces 66, 68, inserting shoulders 58, 60 vertically into vertical slots 54, 56, optionally until the outer forward perimeteral edge 61 of upper cowl 32 engages the outer forward perimeteral edge 63 of the lower cowl 42, or alternatively until lower faces 66, 68 of shoulders 58, 60 engage stop surfaces 62, 64 of vertical slots 54, 56, and pivoting upper cowl 32 (clockwise in FIGS. 6, 7, 3, 4) to pivot the finger 52 into engagement with the retainer 46 at horizontal slot 70 to prevent vertical displacement therefrom.

In the foregoing description, certain terms have been used for brevity, clarity, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A cowl mounting arrangement for an outboard marine drive for propelling a marine vessel, including in a forward direction, said outboard marine drive having an upper powerhead covered by a cowl, said cowl mounting arrangement comprising front and rear mounts coupling said cowl to said outboard marine drive in covering relation to said upper powerhead, said cowl having a mounted condition coupled to said front and rear mounts, a stabilizer fulcrum comprising a vertically extending mounting surface spaced between said front and rear mounts and preloading said cowl to provide cowl stability in said mounted condition;

wherein said cowl has a partially mounted condition in which said cowl is coupled to one of said front and rear mounts prior to being coupled to the other of said front and rear mounts, said cowl being coupled to both of said front and rear mounts in said mounted condition, and said stabilizer fulcrum preloads said cowl as said cowl is moved from said partially mounted condition to said mounted condition, and maintains a torque load across said stabilizer fulcrum on said cowl between said front and rear mounts in said mounted condition;

wherein said outboard marine drive is subject to impact-strike against a submerged object during said propelling of said marine vessel, wherein said impact-strike would cause at least one dislodgement force vector tending to dislodge said cowl from said one mount, wherein said torque load on said cowl provided by said stabilizer fulcrum maintains said cowl in said mounted condition including in engagement with said one mount against said dislodgement force vector.

2. The cowl mounting arrangement according to claim 1 wherein said marine vessel has port and starboard sides, and comprising two said stabilizer fulcrums comprising a port stabilizer fulcrum and a starboard stabilizer fulcrum spaced between said front and rear mounts at laterally distally opposite port and starboard sides of said cowl and preloading said cowl to provide said cowl stability in the mounted condition thereof.

3. The cowl mounting arrangement according to claim 2 wherein:

said cowl is an upper cowl covering said upper powerhead and removable therefrom, and comprising a lower cowl attached to said outboard marine drive and disposed below said upper cowl, said upper and lower cowls having front and rear ends, and port and starboard sides, wherein said port stabilizer fulcrum is on the port side of one of said upper and lower cowls and engages the port side of the other of said upper and lower cowls, and wherein said starboard stabilizer fulcrum is on the starboard side of one of said upper and lower cowls and engages the starboard side of the other of said upper and lower cowls.

4. The cowl mounting arrangement according to claim 2, wherein:

said port stabilizer fulcrum is on said port side of said upper cowl, and said starboard stabilizer fulcrum is on said starboard side of said upper cowl; and said upper cowl is mounted to said outboard marine drive at front and rear latches at said lower cowl, respectively providing said front and rear mounts, one of said front and rear latches comprising a hook on one of said upper and lower cowls, and a retainer on the other of said upper and lower cowls, wherein said dislodgement force vector caused by said impact-strike would release said hook from said retainer but-for said port and starboard stabilizer fulcrums preloading said hook and said retainer.

5. The cowl mounting arrangement according to claim 4, wherein:

said upper cowl is rocked on said port and starboard stabilizer fulcrums until latched by the other of said front and rear latches, wherein engagement of said upper cowl and said lower cowl at said other of said front and rear latches maintains said preload and provides said maintained load.

6. The cowl mounting arrangement according to claim 5, wherein: said hook and said catch are at said front end of said upper and lower cowls, and said other of said front and rear latches is at said rear end of said upper and lower cowls.

7. A cowl mounting arrangement for an outboard marine drive for propelling a marine vessel, including in a forward direction, said outboard marine drive having an upper powerhead covered by a cowl, said cowl mounting arrangement comprising front and rear mounts mounting said cowl to said outboard marine drive in covering relation to said upper powerhead, said cowl having a mounted condition mounted to said front and rear mounts, a stabilizer fulcrum spaced between said front and rear mounts and preloading said cowl to provide cowl stability in said mounted condition;

wherein said cowl has a partially mounted condition engaging one of said front and rear mounts prior to engaging the other of said front and rear mounts, said cowl engages both of said front and rear mounts in said mounted condition, and said stabilizer fulcrum preloads said cowl as said cowl is moved from said partially mounted condition to said mounted condition, and maintains a load on said cowl in said mounted condition;

wherein said outboard marine drive is subject to impact-strike against a submerged object during said propelling of said marine vessel, wherein said impact-strike may cause at least one dislodgement force vector tending to dislodge said cowl from said one mount, wherein said maintained load on said cowl provided by said stabilizer fulcrum maintains said cowl in said mounted condition including in engagement with said one mount against said dislodgement force vector;

wherein said marine vessel has port and starboard sides, and comprising two said stabilizer fulcrums comprising a port stabilizer fulcrum and a starboard stabilizer fulcrum spaced between said front and rear mounts at laterally distally opposite port and starboard sides of said cowl and preloading said cowl to provide said cowl stability in the mounted condition thereof;

said cowl is an upper cowl covering said upper powerhead and removable therefrom, and comprising a lower cowl attached to said outboard marine drive and disposed below said upper cowl, said upper and lower cowls having front and rear ends, and port and starboard sides, wherein said port stabilizer fulcrum is on the port side of one of said upper and lower cowls and engages the port side of the other of said upper and lower cowls, and wherein said starboard stabilizer fulcrum is on the starboard side of one of said upper and lower cowls and engages the starboard side of the other of said upper and lower cowls;

said upper cowl is mounted to said outboard marine drive at front and rear latches at said lower cowl, respectively providing said front and rear mounts, one of said latches comprising a hook on one of said upper and lower cowls, and a retainer on the other of said upper and lower cowls, wherein said dislodgement force vector caused by said impact-strike tends to release said hook from said retainer but-for said port and starboard stabilizer fulcrums preloading said hook and said retainer;

wherein said upper cowl is rocked on said port and starboard stabilizer fulcrums about said pivot-engagement to preload said hook and said retainer;

said upper cowl is rocked on said port and starboard stabilizer fulcrums about said pivot-engagement until latched by the other of said latches, wherein engagement of said upper cowl and said lower cowl at said other latch maintains said preload and provides said maintained load;

said hook has a finger engaging said retainer and preventing vertical displacement therefrom in said mounted condition with said maintained load provided by said port and starboard stabilizer fulcrums;

said retainer has at least one vertical slot therein, said hook has at least one shoulder extending vertically into said vertical slot, and said shoulder and said vertical slot prevent horizontal displacement of said hook from said retainer in said mounted condition with said maintained load provided by said port and starboard stabilizer fulcrums.

8. The cowl mounting arrangement according to claim 4 wherein said hook pivots with the cowl to engage said retainer during assembly to said mounted condition.

9. The cowl mounting arrangement according to claim 7 wherein said vertical slot of said retainer has a stop surface, said shoulder of said hook has a lower face facing said stop surface of said slot.

10. A cowl mounting arrangement for an outboard marine drive for propelling a marine vessel, including in a forward direction, said marine vessel having port and starboard sides, said outboard marine drive having an upper powerhead, an upper cowl covering said upper powerhead, a lower cowl attached to said outboard marine drive and disposed below said upper cowl, said cowl mounting arrangement comprising front and rear mounts removably coupling said upper cowl to said outboard marine drive at said lower cowl, and port and starboard alignment guides respectively guiding the port side of said upper cowl into alignment with the port side of said lower cowl and guiding the starboard side of said upper cowl into alignment with the starboard side of said lower cowl said port and starboard alignment guides also comprise port and starboard stabilizer fulcrums each comprising a vertically extending mounting surface spaced between said front and rear mounts at laterally distally opposite port and starboard sides of said cowl and preloading said cowl to provide cowl stability in the mounted condition thereof;

each of said port and starboard alignment guides has a vertical guide surface providing alignment guiding, and a horizontal trunnion surface providing a respective stabilizer fulcrum;

wherein said cowl has a partially mounted condition wherein said cowl is coupled to one of said front and rear mounts prior to being coupled to the other of said front and rear mounts, said cowl is coupled to both of said front and rear mounts in said mounted condition, and said stabilizer fulcrum preloads said cowl as said cowl is moved from said partially mounted condition to said mounted condition, and maintains a torque load across said stabilizer fulcrum on said cowl between said front and rear mounts in said mounted condition;

wherein said outboard marine drive is subject to impact-strike against a submerged object during said propelling of said marine vessel, wherein said impact-strike would cause at least one dislodgement force vector tending to dislodge said cowl from said one mount, wherein said torque load on said cowl provided by said stabilizer fulcrum maintains said cowl in said mounted condition including in engagement with said one mount against said dislodgement force vector.

11. The cowl mounting arrangement according to claim 10 wherein:

said port and starboard alignment guides are on said upper cowl;

said upper cowl has a lower perimeteral edge facing said lower cowl, and wherein said port and starboard alignment guides extend downwardly beyond said lower perimeteral edge.

12. The cowl mounting arrangement according to claim 10 comprising four said alignment guides comprising two port alignment guides and two starboard alignment guides, said two port alignment guides comprising a forward port alignment guide and an aft port alignment guide spaced rearwardly of said forward port alignment guide, said two starboard alignment guides comprising a forward starboard alignment guide and an aft starboard alignment guide spaced rearwardly of said forward starboard alignment guide.

13. A method for mounting a cowl on an outboard marine drive propelling a vessel, including in a forward direction, said outboard marine drive having an upper powerhead covered by said cowl and having front and rear mounts for mounting said cowl to said outboard marine drive in covering relation to said upper powerhead, said method comprising:

coupling said cowl with said outboard marine drive at one of said front and rear mounts;

providing a stabilizer fulcrum comprising a vertically extending mounting surface spaced between said front and rear mounts, and pivoting said cowl on said stabilizer fulcrum;

continuing to pivot said cowl to a mounted position coupling the other of said front and rear mounts;

maintaining, by use of said stabilizer fulcrum, a torque load across said stabilizer fulcrum on said cowl between said front and rear mounts in said mounted position;

wherein said outboard marine drive is subject to impact-strike against a submerged object during said propelling of said marine vessel, wherein said impact-strike would cause at least one dislodgement force vector which tends to dislodge said cowl from said one mount, and maintaining, by use of said stabilizer fulcrum, said torque load on said cowl and said one of said front and rear mounts in said mounted condition, including in engagement with said one mount, against said dislodgement force vector.

14. The method according to claim 13 wherein said marine vessel has port and starboard sides, and comprising providing two said stabilizer fulcrums comprising a port stabilizer fulcrum and a starboard stabilizer fulcrum, and rocking said cowl on both of said stabilizer fulcrums, and wherein said cowl is an upper cowl covering said upper powerhead and removable therefrom, and wherein a lower cowl is attached to said outboard marine drive and disposed below said upper cowl, said upper and lower cowls having front and rear ends, and port and starboard sides, wherein said port stabilizer fulcrum is on the port side of one of said upper and lower cowls and engages the port side of the other of said upper and lower cowls, and wherein said starboard stabilizer fulcrum is on the starboard side of one of said upper and lower cowls and engages the starboard side of the other of said upper and lower cowls and comprising rocking said upper cowl on both of said stabilizer fulcrums.

15. The method according to claim 14 wherein said upper cowl is mounted to said outboard marine drive at front and rear latches at said lower cowl, respectively providing said front and rear mounts, and comprising providing one of said latches as a hook on one of said upper and lower cowls, and a retainer on the other of said upper and lower cowls, wherein said dislodgement force vector caused by said impact-strike may release said hook from said retainer but-for the preloading provided by the rocking of said upper cowl on said port and starboard stabilizer fulcrums.

16. The method according to claim 15 comprising providing port and starboard alignment guides at said port and starboard stabilizer fulcrums, and comprising, during said rocking of said upper cowl, guiding the port side of said upper cowl at said port stabilizer fulcrum and said port alignment guide into alignment with said port side of said lower cowl, and during said rocking of said upper cowl, guiding the starboard side of said upper cowl at said starboard stabilizer fulcrum and said starboard alignment guide into alignment with the starboard side of said lower cowl.

17. A method for mounting a cowl on an outboard marine drive propelling a vessel, including in a forward direction, said outboard marine drive having an upper powerhead covered by said cowl and having front and rear mounts for mounting said cowl to said outboard marine drive in covering relation to said upper powerhead, said method comprising:

engaging said cowl with said outboard marine drive at one of said front and rear mounts;

providing a stabilizer fulcrum spaced between said front and rear mounts, and pivoting said cowl on said stabilizer fulcrum;

continuing to pivot said cowl to a mounted position engaging the other of said front and rear mounts;

maintaining, by use of said stabilizer fulcrum, a load on said cowl in said mounted position;

wherein said outboard marine drive is subject to impact-strike against a submerged object during said propelling of said marine vessel, wherein said impact-strike may cause at least one dislodgement force vector which may dislodge said cowl from said one mount, and maintaining, by use of said stabilizer fulcrum, said maintained load on said cowl in said mounted condition, including in engagement with said one mount, against said dislodgement force vector;

wherein said marine vessel has port and starboard sides, and comprising providing two said stabilizer fulcrums comprising a port stabilizer fulcrum and a starboard stabilizer fulcrum, and rocking said cowl on both of said stabilizer fulcrums, and wherein said cowl is an upper cowl covering said upper powerhead and removable therefrom, and wherein a lower cowl is attached to said outboard marine drive and disposed below said upper cowl, said upper and lower cowls having front and rear ends, and port and starboard sides, wherein said port stabilizer fulcrum is on the port side of one of said upper and lower cowls and engages the port side of the other of said upper and lower cowls, and wherein said starboard stabilizer fulcrum is on the starboard side of one of said upper and lower cowls and engages the starboard side of the other of said upper and lower cowls and comprising rocking said upper cowl on both of said stabilizer fulcrums;

wherein said upper cowl is mounted to said outboard marine drive at front and rear latches at said lower cowl, respectively providing said front and rear mounts, and comprising providing one of said latches as a hook on one of said upper and lower cowls, and a retainer on the other of said upper and lower cowls, wherein said dislodgement force vector caused by said impact-strike may release said hook from said retainer but-for the preloading provided by the rocking of said upper cowl on said port and starboard stabilizer fulcrums;

providing one of said latches as a hook on one of said upper and lower cowls, and a retainer on the other of said upper and lower cowls, providing said hook with a finger engaging said retainer and preventing vertical displacement therefrom, providing said retainer with at least one vertical slot therein, providing said hook with at least one shoulder, and comprising sliding said shoulder vertically into said vertical slot, and then pivoting said hook on said retainer such that said finger engages said retainer to prevent said vertical displacement therefrom.

* * * * *